United States Patent [19]

Dixon

[11] 3,981,725

[45] Sept. 21, 1976

[54] PROCESS AND SYSTEM FOR FORMING FINISHED PARTS FROM POWDER METAL

[75] Inventor: William F. Dixon, Rochester, N.Y.

[73] Assignee: The Gleason Works, Rochester, N.Y.

[22] Filed: Mar. 6, 1974

[21] Appl. No.: 448,783

[52] U.S. Cl. ..... 75/200; 29/420.5; 29/DIG. 13; 75/214; 425/78

[51] Int. Cl.[2] ..... B22F 1/00; B22F 3/24; B22F 3/00

[58] Field of Search ..... 75/200, 214; 29/DIG. 13, 420.5; 425/78

[56] References Cited

UNITED STATES PATENTS

| | | | |
|---|---|---|---|
| 2,561,583 | 7/1951 | Marvin | 75/200 |
| 3,722,870 | 3/1973 | Griffin | 75/200 |
| 3,779,747 | 12/1973 | Conta | 75/200 |

OTHER PUBLICATIONS

"Computer Simulation Techniques" by Naylor John Wiley & Sons, Inc., N.Y. (1966), pp. 126–129, 136, 164–167.

"General Purpose Simulation System/360 Introduction Concepts & Case Studies" By Schriber (1968), pp. 65–70, 193–194.

*Primary Examiner*—Samuel Feinberg
*Assistant Examiner*—Donald P. Walsh
*Attorney, Agent, or Firm*—Ralph E. Harper

[57] ABSTRACT

An industrial process and system are described for forming finished parts from powder metal. Known steps of compacting the metal powder into a preliminary part having an intermediate shape, followed by heating and forming the preliminary powder into a finished part having a final shape and density are integrated into a single automated process and system by steps and equipment which provide for a rearranging of a continuous flow of preliminary parts into separate batches at a sintering station so that the separate batches of the preliminary parts can be uniformly heated to a selected sintering temperature level. After sintering, the separate batches are removed from the sintering station and rearranged back into a flow of parts which can be conveyed to a final forming station. This arrangement provides for advantages in starting up and stopping the system in a typical industrial application.

9 Claims, 3 Drawing Figures

PROCESS AND SYSTEM FOR FORMING FINISHED PARTS FROM POWDER METAL

Background and Brief Description of Invention

It is known in the art to produce high strength finished parts from metal powder by initially compacting a measured quantity of the metal powder into a coherent preliminary shape, followed by steps of heating and forming the preliminary part into a finished part having a final shape and density. Initial compacting of the powder metal can be carried out with a known mechanical or isostatic compacting device which produces a coherent preliminary part that can be more easily handled during subsequent steps of heating and forming. Heating can be carried out in known furnace equipment, for example in an induction or radiant heating type of furnace, which functions to raise the temperature level of the preliminary part to a sintering temperature. After sintering, the preliminary part is partially cooled down to an optimum forming temperature, and forming takes place in a forming or forging press.

Prior art uses of known technology and equipment have tended to separate the various processing steps so that one piece of equipment does not depend upon the continued operation of another type of equipment for carrying out the total process, however, attempts have been made to integrate the separate processing steps and pieces of equipment by extending transfer devices and conveying equipment between them. These prior art attempts have been characterized by the use of a continuous flow of production parts through the system from the point where loose powder is received to the point where a final part is formed.

In contrast to known prior art arrangements, the present invention provides for a single automated system having a production flow pattern which starts out as a continusou flow but which is subsequently rearranged into separate batches at a sintering station so that the separate batches of preliminary parts can be uniformly heated to selected sintering temperature levels. After sintering, the batches of preliminary parts are rearranged back into a flow of parts which can be conveyed to a final forming station. Thus, instead of maintaining a continuous flow of parts through all stations of the system, the present invention purposely interrupts the continuous flow in order to establish a batching operation at the sintering station.

Even though the process and system of the present invention involves two steps of rearranging an otherwise continuous flow of parts, the integrated process and system of the present invention offer certain industrial advantages over known prior art arrangements which have been suggested to industry. By rearranging a flow of preliminary parts into separate batches at a sintering station, it is possible to start-up and stop an automated system with less loss of time and scrap than might be the case in a system relying solely on continuous flow of parts from one end to the other. This advantage is especially noticeable when induction heating is used to raise the temperature of preliminary parts to a sintering level at a sintering station. Sintering stations which attempt to provide for a through flow of parts through an induction coil require close control of a temperature profile within the sintering station from the beginning to the end of the induction coil. This profile can be more easily maintained once steady state conditions of through-put of parts are established, but initial start-up and shut-down of the system can result in a change in heating characteristics of the induction coil when a lesser number of parts is contained within the coil. The present invention avoids this problem by purposely rearranging parts into separate batches which can be inserted into induction coils for heating at preferred temperature levels for the entire length of each coil without reference to a temperature "profile" along the length of the coil. Heating takes place only after each induction coil is fully loaded, and not during loading and unloading operations, thereby avoiding any change in heating characteristic for the coil during such operations. All parts are heated equally for equal times, and the sintering station can be started up and stopped without electrically compensating for a difference in the number of parts-in-process which may exist with continuous flow type systems.

In addition to improving start-up and stopping procedures for the integrated process and system, the present invention offers an economical use of a power supply for induction furnace equipment. By rearranging a continuous flow of preliminary parts into at least two separate batches, it is possible to switch current from a single power source to the separate batches in an alternating sequence which allows maximum use of the single power source during passage of the preliminary parts through the sintering station. This provides a very efficient use of costly induction heating equipment while, at the same time, reducing the amount of control which would otherwise be needed to respond to changing numbers of parts passing continuously through an induction heating coil.

These and other features and advantages of the present invention will become apparent in the more detailed discussion which follows. In that discussion, reference will be made to the accompanying drawings as briefly described below.

Detailed Description of Invention

Figure 1:
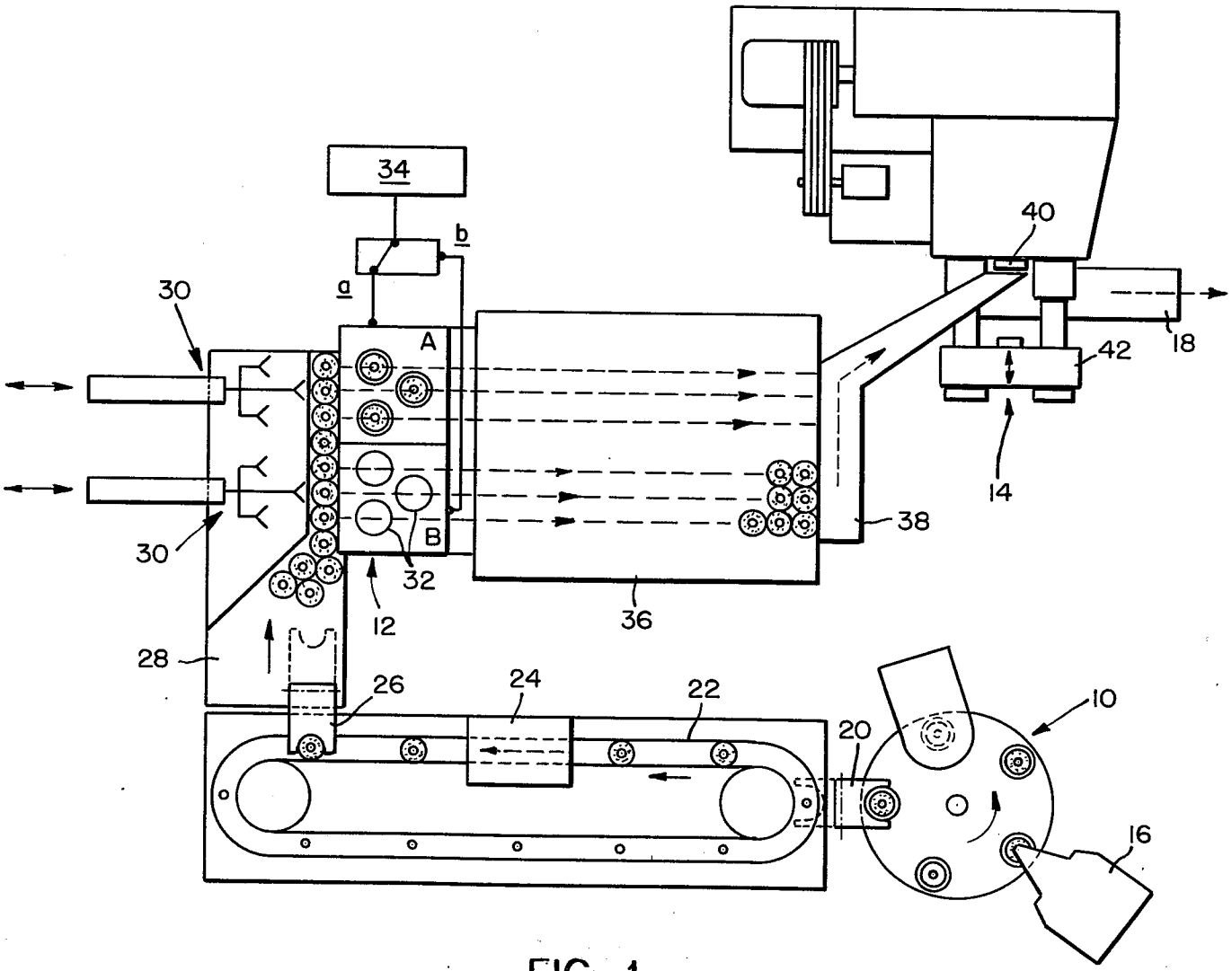
FIG. 1 is a schematic view, in top plan, of an overall system for producing finished parts from metal powder in accordance with the present invention.

Referring to FIG. 1, a typical integrated system in accordance with the present invention is illustrated. The system includes a compacting station 10, a sintering station 12, and a final forming station 14. These stations are integrated with each other so that loose metal powder can be dispensed and metered from a source of supply 16 to the compacting station 10 at a rate which will match the production of final parts at the final forming station 14. All processing steps are carried out automatically from beginning to end.

A preferred embodiment of the overall system provides for isostatic compacting of preliminary parts, having intermediate shapes, at the compacting station 10. Various forms of isostatic compacting equipment are known in the art, and such equipment typically includes means for dispensing measured quantities of a metal powder into an elastomeric mold which can be isostatically pressurized to compact the powder into a coherent intermediate shape. The preliminary part which is produced at the compacting station 10 is transferred with a transfer device 20 onto a conveying means 22.

The conveying means 22 advances the preliminary part through a pretreating station 24 for adjusting electrical resistivity characteristics of the preliminary part prior to induction sintering. A pretreating process of this type is described in U.S. Pat. No. 3,779,747 issued on Dec. 18, 1973 to Robert L. Conta. From the pretreating station 24, the conveying means 22 advances each preliminary part to a second transfer device 26 which lifts each part away from the conveying means 22 and onto an endless conveyor belt 28, or its equivalent. The conveyor belt 28 functions to create a part bank which makes parts available to loading devices 30 associated with the sintering station 12.

The loading devices 30 function to rearrange the continuous supply of preliminary parts into separate batches which can be separately heated at the sintering station 12. In the illustrated embodiment, each loading device 30 is designed to transfer three preliminary parts from the conveyor belt 28 into one of two sintering sections A or B of the sintering station 12. At least two sintering sections A or B are provided so that two or more separate batches of preliminary parts can be treated on an alternating time cycle at the sintering station. Each sintering section includes three vertical, induction heating coils 32 (also see FIG. 2) for receiving a stack of preliminary parts (for example fifteen or more preliminary parts can be stacked in each induction coil 32). The induction heating coils 32 can be operated at a nominal frequency of about 3 kHz with a power level in the range of 100 to 300 kilowatts, for example. One of the sintering sections A or B is loaded or unloaded at any given time, and thus, one of the loading devices 30 reciprocates back and forth into and out of alignment with the induction heating coils of its associated section until a full number of parts have been loaded upwardly into the three induction heating coils of that section. Upon completion of loading of one of the sintering sections A or B of the sintering station 12, electrical current from a power supply 34 is switched to the loaded sintering section through one of the circuits *a* or *b*, and all parts are uniformly heated up to a desired sintering temperature level for a desired length of time. Preferably all of the induction coils 32 of a given sintering section (A or B) are connected in series in order to obtain more uniform heating characteristics among the coils. For example, a high temperature sintering process would raise the temperature level of all parts to approximately 1315°C. After sintering, the batch of parts contained within the loaded sintering section is partially cooled down to a forming temperature level in the range of approximately 980°C. to 1090°C. Thus, each batch of parts is substantially uniformly heated, and there is no requirement to establish a temperature profile along the length of the induction heating coils 32 during the heating operation. All induction heating coils 32 of a given section are heated up simultaneously with a full load of parts, and there is no requirement to "regulate" the induction heating coils during start-up or shut-down of the system at the beginning or end of a work shift.

After initial cooling, the sintered preliminary parts are rearranged back into a flow of preliminary parts which are advanced into a holding furnace 36. The holding furnace 36 functions (a) to equalize the temperature of each part as it is received in a partially cooled condition from the sintering station, (b) to establish and maintain a preferred forming temperature for all parts before transfer to the forming station, and (c) to accept and hold a substantial number of parts during any temporary shut-down of the forming station. The holding furnace can be of any well known construction to provide for temperature and atmosphere control for parts that are banked therein prior to final forming at the forming station 14. Hot preliminary parts are transferred from the holding furnace 36 to the forming station 14 on a demand basis with transfer and conveying means 38 of any suitable structure for regulating a continuous flow of parts down to a die 40 contained within the forming station 14. A ram 42 of the forming station reciprocates back and forth to fully form each preliminary part into a final shape and density. The finished parts are then conveyed away with known conveying equipment 18.

Figure 2:
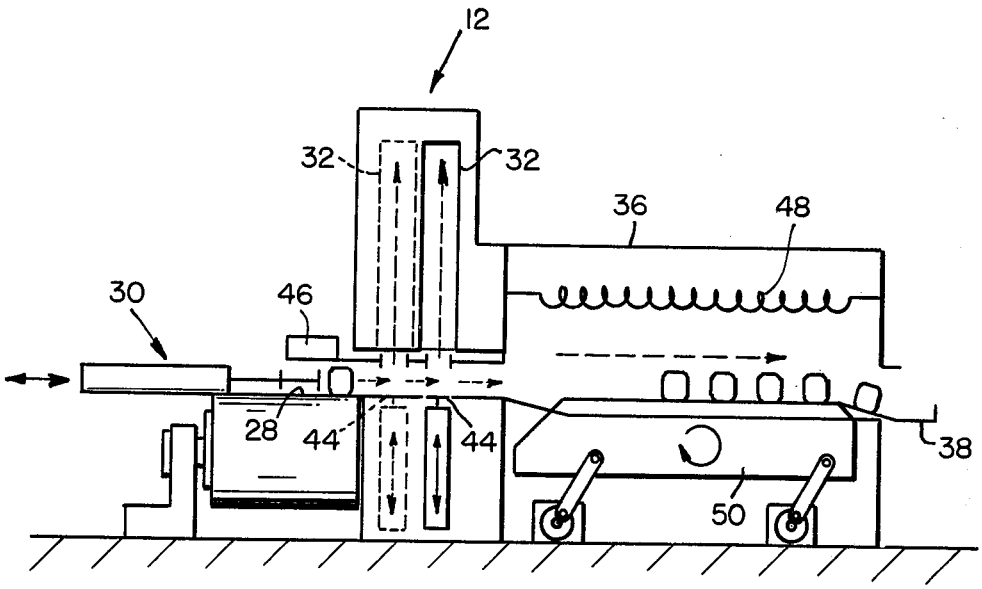
FIG. 2 is a schematic view, in elevation, of a sintering station portion of the system illustrated in FIG. 1, and including associated equipment for loading and unloading parts into and out of the sintering station.

FIG. 2 schematically illustrates additional details of equipment which may be used for converting a continuous flow of preliminary parts into separate batches at the sintering station 12 of a system arranged in accordance with the present invention. As previously discussed, parts are selected and transferred from the conveyor 28 with loading devices 30 which function to move the parts in aligned positions beneath the separate induction heating coils 32 of a given sintering section A or B. The parts are advanced onto lifting devices 44 which can be lifted upwardly into associated induction heating coils 32 for stacking a number of preliminary parts within each induction heating coil. Stacking is accomplished by lifting each part to a preselected level where it is temporarily clamped by a clamping device 46. The parts are held by the clamping device 46 until a subsequent number of parts are advanced beneath and lifted upwardly toward the induction coils being loaded. When the subsequent parts reach the lower surface levels of the clamped parts, the clamping device 46 is released so that the subsequent parts can be lifted upwardly to the clamping level. Upward movement of the subsequent parts advances the previously clamped parts upwardly in a stack. This operation is repeated until a full number of preliminary parts has been received into the three induction heating coils 32 of a given sintering section. At that time, all of the parts of the stack are lifted completely within the field defined by the induction coils 32, and induction heating is initiated.

After induction sintering has taken place, parts are cooled down to a forming temperature level and are unloaded from the induction coils by an unloading technique which is similar to the one used for loading. In other words, the lifting devices 44 are used to lower individual stacks of parts to a level where a next to lowermost part in each stack can be clamped while the lowermost part is pushed off and into the holding furnace 36. The holding furnace 36 may comprise an insulated furnace heated by resistance heating rods 48, and a protective atmosphere is preferably provided to prevent oxidation of the hot parts contained therein. The holding furnace 36 is illustrated as including a walking beam floor structure 50 for advancing parts from an inlet to an outlet end of the furnace. At the outlet end of the furnace, parts are received by the transfer and conveying mechanism 38 which feeds parts to the forming station 14.

Figure 3:
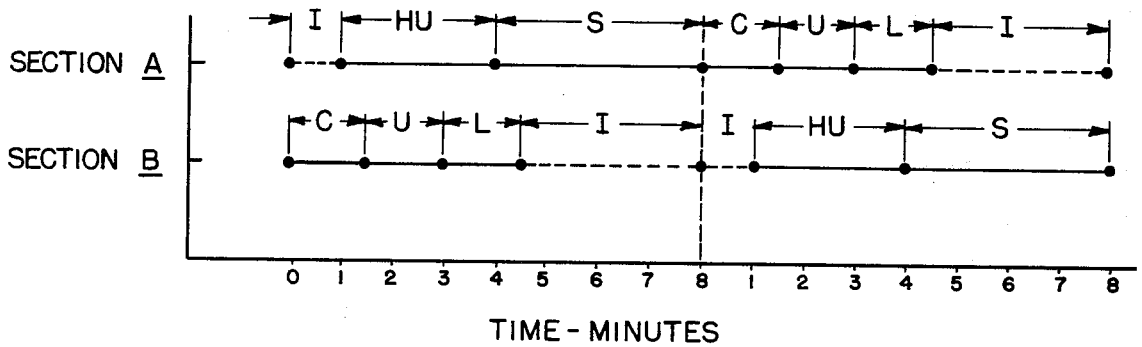
FIG. 3 is a graphic portrayal of a typical relationship of processing steps for separate batches of a process being carried out in accordance with the present invention.

FIG. 3 illustrates an example of an operating relationship between the sintering sections A and B. It can be seen that the operating relationship is such that the heating up (HU) time and sintering (S) time for a batch of parts in one sintering section is approximately equal to the time it takes to cool (C), unload (U) and reload (L) parts in the other sintering section. In the illustrated example, a heating cycle for a given sintering section includes a one minute idle (I) time, followed by a switching on of power and a three minute heating up (HU) time. Once heating up is accomplished temperature is maintained for a four minute sintering (S) time. In this same example, the other sintering section is carrying out a cooling down (C) of a previously sintered batch for approximately one and one-half minutes so as to reduce the temperature level of the parts down to a preferred forming temperature level. After cooling, the parts are unloaded (U) in approximately one and one-half minutes and a new batch of parts are loaded (L) in about the same length of time. There is an idle (I) period of about three and one-half minutes to permit adjustments in cooling and loading times, if needed. The illustrated operations provide for eight minute cycle times for each of the sintering sections A or B. Of course, the times which have been discussed above can be varied according to specific part size and processing requirements.

Although the invention has been described with reference to a preferred embodiment, it can be appreciated that certain equivalent structures can be substituted for those described without departing from the basic concepts of this invention. For example, it is possible to provide more than two sintering sections in the sintering station 12, and current can be switched from a single power source to each of the sintering sections so as to provide for a continuous use of the power source. Greater or lesser numbers of induction coils may be provided in each sintering section, although a lesser number of coils may require a use of longer coils in order to accommodate a given number of parts for a given production rate. Also, it is not necessary to use a walking beam conveyor in the holding furnace 36 and equivalent conveying means may be substituted.

The system which has been described is capable of producing more than 450 parts per hour and even more than 700 parts per hour, depending upon sintering time requirements for the particular part being manufactured and time limitations of equipment used at the compacting and final forming stations. Various power supply boxes and control panels have been omitted from the schematic illustrations discussed above since they are well known in the art and do not form a separate part of the present invention.

It is contemplated that means which are fully equivalent to those discussed above may be used for rearranging the preliminary parts into and out of the batches which are required for the process of this invention, and substitution of such equivalent means is intended to be included within the scope of the claims defined hereinafter.

What is claimed is:

1. In an industrial process for forming finished parts from metal powder by initially compacting a measured quantity of metal powder into a coherent preliminary part having an intermediate shape, followed by steps of heating and forming the preliminary part into a finished part having a final shape and density, the improvement of integrating the steps of such a process into a single automated system, comprising compacting loose powder metal with a process which produces a continuous flow of preliminary parts, conveying and transferring said preliminary parts to an induction sintering station, rearranging the continuous flow of preliminary parts into separate batches in the induction sintering station so that separate batches of the preliminary parts can be uniformly heated to a selected sintering temperature level in alternating time sequence, removing the batches of preliminary parts from the induction sintering station after sintering is completed, and rearranging the batches of preliminary parts back into a flow of parts which can be conveyed to a final forming station, and transferring parts from said flow of parts to a forming station where said preliminary parts are formed into finished parts having a final shape and density.

2. The improved process of claim 1 wherein said rearranging of preliminary parts into separate batches in a sintering station includes steps of establishing first and second batches in an alternating time sequence so that one batch can be heated to a sintering temperature level while the other batch is being rearranged into or out of its batch condition.

3. The improved process of claim 2 wherein said preliminary parts are heated to a sintering temperature level with induction heating means having a single power source, and including a step of switching current from said single power source to said first and second batches in an alternating sequence which allows maximum use of the single power source during the steps of rearranging preliminary parts into and out of their batch conditions at the sintering station.

4. The improved process of claim 2 wherein said first and second batches are alternated in such a way that one batch is heated up to a sintering temperature level and maintained at that temperature level for a sufficient length of time to uniformly sinter all of the preliminary parts contained in that batch while the other batch is cooled down to a forming temperature level and unloaded from the sintering station.

5. In an industrial system for forming finished parts from metal powder by initially compacting a measured quantity of metal powder into a coherent preliminary part having an intnermediate shape, followed by steps of heating and forming the preliminary part into a finished part having a final shape and density, the improved in such a system comprising an arrangement for regulating the production flow of parts through the system, characterized by compacting means for receiving measured quantities of loose metal powder and for producing a continuous flow of coherent preliminary parts from said loose metal powder, conveying and transferring means for advancing said preliminary parts to a sintering station, an induction sintering station for inductively heating at least two separate batches of said preliminary parts in an alternating time cycle so that one batch can be heated while other batches are being unloaded from and reloaded into the sintering station, loading means for rearranging the continuous flow of parts into batches of preliminary parts which can be loaded into and uniformly heated and at the induction sintering station, unloading means for rearranging batches of preliminary parts from said induction sintering station into a flow of parts which can be conveyed to a forming station, and transferring means for feeding a continuous flow of said preliminary parts to a forming station for being formed into a final shape and density.

6. The system of claim 5 wherein said induction sintering station includes first and second induction heating sections for separately heating two separate batches of preliminary parts which are loaded into and unloaded from said induction sintering station.

7. The system of claim 6 and including a power source for operating induction heating coils associated with said first and second induction heating sections, and including switching means for alternately switching current from said power source to one or the other of said induction heating sections.

8. The system of claim 5 and including a holding station located between said induction sintering station and said forming station for holding preliminary parts at a selected temperature level for the final forming of the parts at the forming station.

9. The system of claim 8 wherein said holding station is heated by resistance heating means to maintain preliminary parts contained therein at said selected temperature level.

* * * * *